US006817747B2

(12) United States Patent
Preisser et al.

(10) Patent No.: US 6,817,747 B2
(45) Date of Patent: Nov. 16, 2004

(54) PORTABLE VARIABLE SPEED VOLUMETRIC FEED HOPPER

(76) Inventors: Mark Preisser, 1605 Opal Rd., Kearney, MO (US) 64060; Robert J. Fox, 11817 County Highway A, Kiel, WI (US) 53042

( * ) Notice: Subject to any disclaimer, the term of this patent is extended or adjusted under 35 U.S.C. 154(b) by 51 days.

(21) Appl. No.: 10/299,829

(22) Filed: Nov. 20, 2002

(65) Prior Publication Data

US 2004/0095841 A1 May 20, 2004

(51) Int. Cl.[7] ..... B01F 15/02
(52) U.S. Cl. ..... 366/38; 366/156.1
(58) Field of Search ..... 366/19–20, 26, 366/38, 41, 50, 156.1, 186

(56) References Cited

U.S. PATENT DOCUMENTS 3,885,774 A * 5/1975 Harris et al. ..... 366/20
4,075,711 A * 2/1978 Hall ..... 366/26
4,127,487 A * 11/1978 Havalda ..... 210/350
4,754,557 A * 7/1988 Anderson ..... 34/174
4,953,752 A * 9/1990 Tousignant et al. ..... 222/23
4,956,821 A * 9/1990 Fenelon ..... 366/8
5,312,051 A * 5/1994 Preisser
5,556,196 A * 9/1996 Lin ..... 366/18
5,695,560 A * 12/1997 Hession ..... 222/185.1
5,785,420 A * 7/1998 Schuff ..... 366/20
6,000,645 A * 12/1999 Preisser
6,112,955 A * 9/2000 Lang ..... 222/626
6,193,403 B1 * 2/2001 Nystrom ..... 366/26
6,206,249 B1 * 3/2001 Lang et al. ..... 222/412
6,325,311 B1 * 12/2001 Preisser ..... 241/74
6,666,573 B2 * 12/2003 Grassi ..... 366/26

FOREIGN PATENT DOCUMENTS

EP 0093473 * 11/1983
WO 92/19432 * 11/1992

* cited by examiner

*Primary Examiner*—Charles E. Cooley
(74) *Attorney, Agent, or Firm*—Richard C. Litman

(57) ABSTRACT

A volumetric feed hopper is provided with a variable speed drive to vary the feed rate of the hopper. The hopper is further provided with adjustable legs with pivoting feet to enable the hopper to be installed a various heights and on uneven surfaces.

5 Claims, 6 Drawing Sheets

PORTABLE VARIABLE SPEED VOLUMETRIC FEED HOPPER

BACKGROUND OF THE INVENTION

1. Field of the Invention

The present invention relates to a portable feed hopper for a concrete reclaiming apparatus, and more particularly to a portable variable speed volumetric feed hopper.

2. Description of the Related Art

The related art shows that apparatus for reclaiming the aggregates of unused concrete is well known. For example, U.S. Pat. No. 4,127,487 issued Nov. 28, 1978 to Miller teaches a machine for salvaging waste concrete material. Miller teaches the use of a hopper fixed on the machine for receiving residual mixed concrete from ready mix trucks. A movable apertured disc at a lower end of the hopper starts and stop the flow of rinse water mixed with concrete from the hopper into the machine. The Miller machine has the disadvantage of not having a means for controlling the efficiency of the reclaiming process when, for example, a concrete with different aggregate content is being reclaimed.

In U.S. Pat. No. 3,885,774 issued May 27, 1975 to Harris et al., an apparatus is shown for preparing and dispensing mixtures of concrete and fibers. Materials for the concrete mix are provided in 3 hoppers. The proportions of the cement and aggregate are varied by adjusting the gearing in the drive of the hopper feed screw or using feed screws having different dimensions, flights or pitch in the various hoppers.

U.S. Pat. No. 6,325,311 issued Dec. 4, 2001 to Preisser shows that the use of constant feed hoppers attached at the input of concrete reclaimers to supply unused concrete from cement trucks into the reclaimers is also known in the field of concrete reclaiming.

None of the above inventions and patents, taken either singularly or in combination, is seen to describe the instant invention as claimed. Thus a variable speed volumetric feed hopper solving the aforementioned problems is desired.

SUMMARY OF THE INVENTION

The present invention is a portable volumetric feed hopper for concrete reclaiming apparatus that is supported upon adjustable legs to enable the hopper to be installed at different of heights above the ground. Each leg includes a pivoting foot to enable installation of the hopper on uneven surfaces. The hopper includes a variable speed drive to enable the feed rate of the hopper to be adjusted to the optimal rate for any particular make or style of concrete reclaimer.

Accordingly, it is a principal object of the invention to provide a variable speed volumetric feed hopper having adjustable legs with pivoting feet that can be positioned to supply concrete to different types of concrete reclaiming devices at an optimum feed rate for each particular device.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
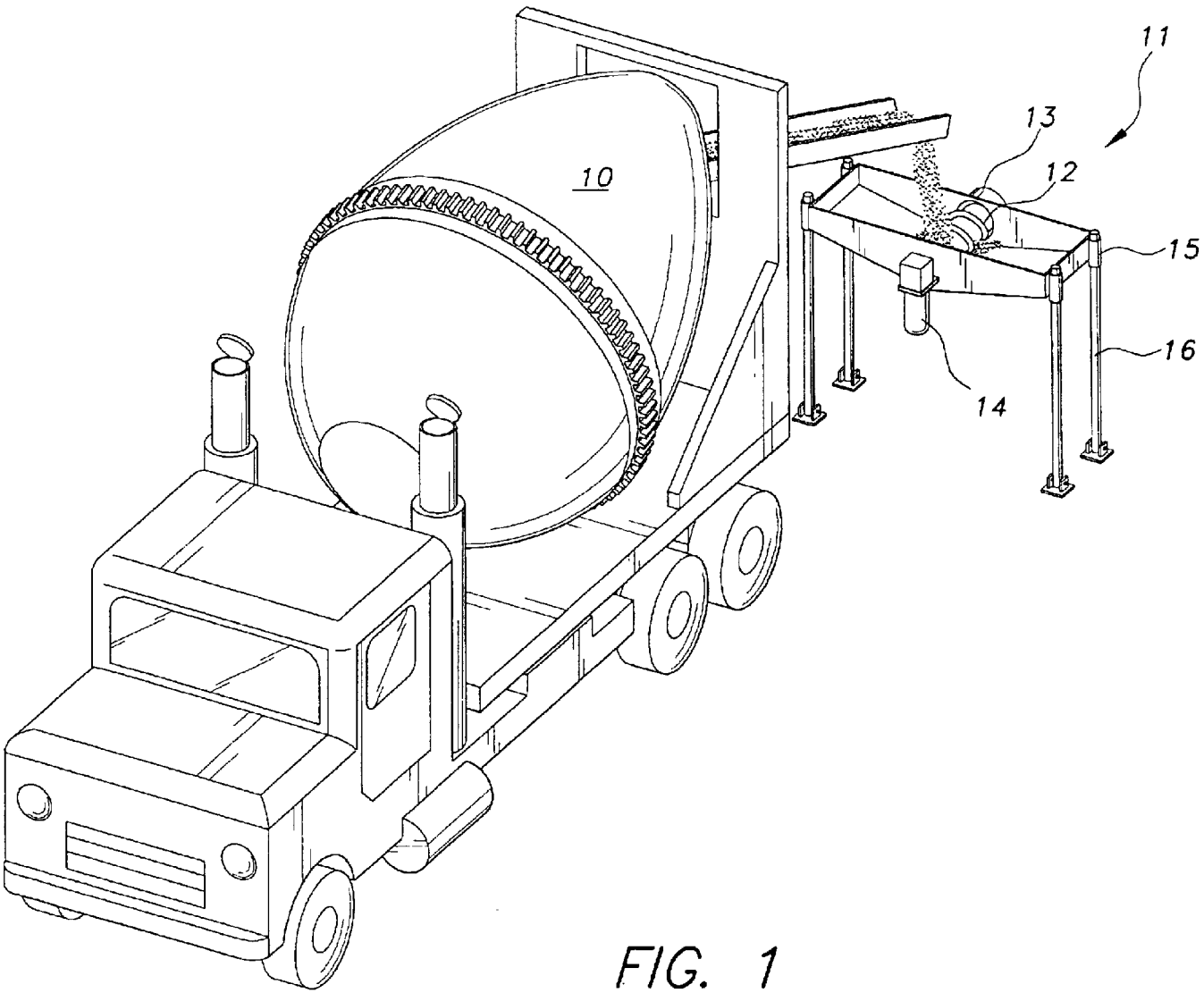
FIG. 1 is an environmental, perspective view of a variable speed volumetric feed hopper according to the present invention.
Figure 2:
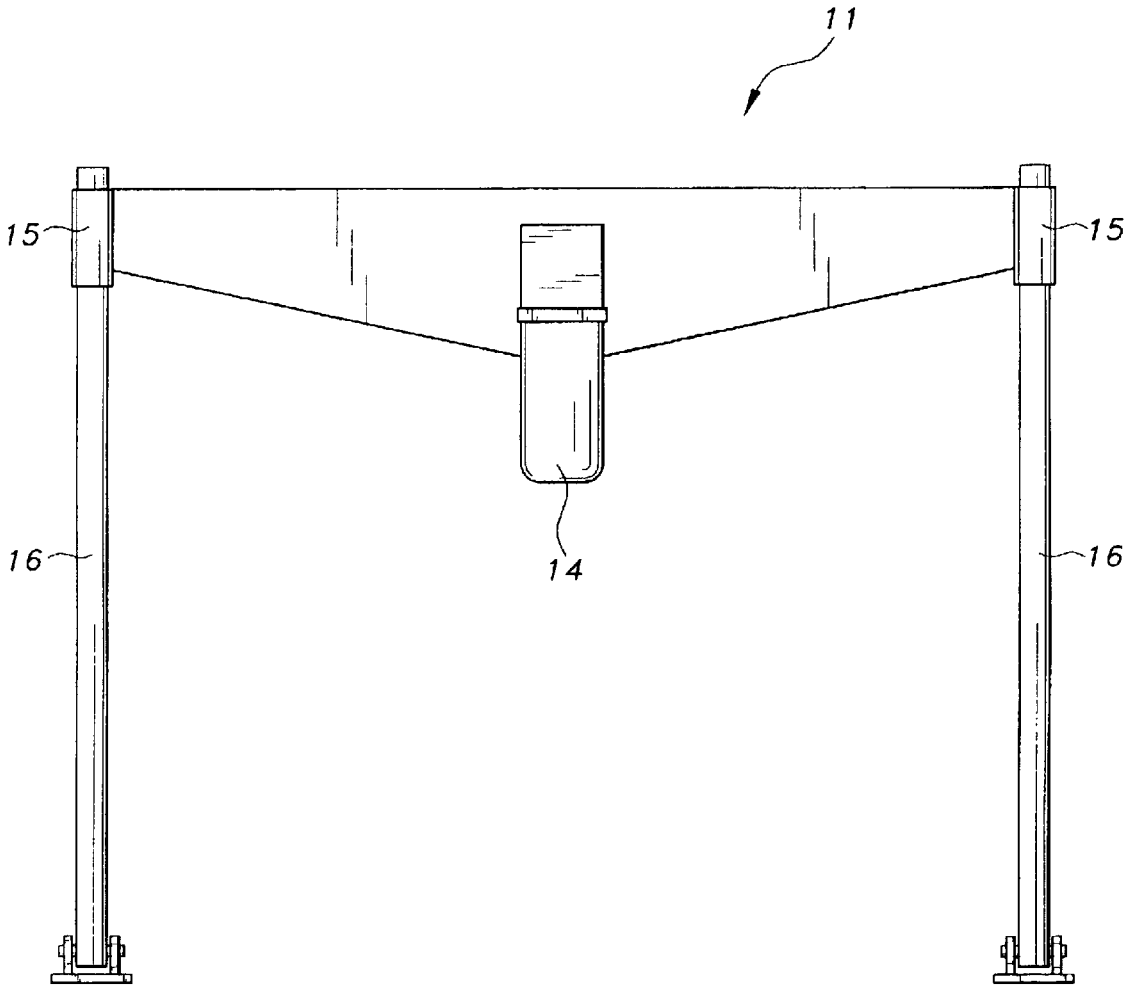
FIG. 2 is a front view of the variable speed feed hopper according to the present invention.
Figure 3:
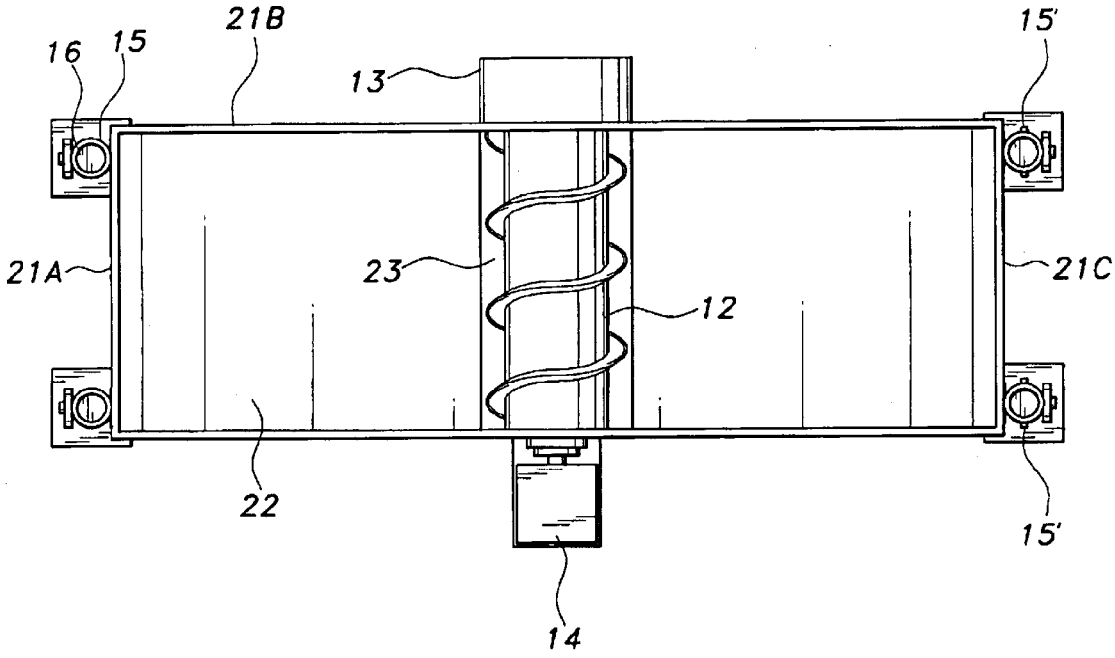
FIG. 3 is a top view of the variable speed feed hopper according to the present invention.
Figure 4:
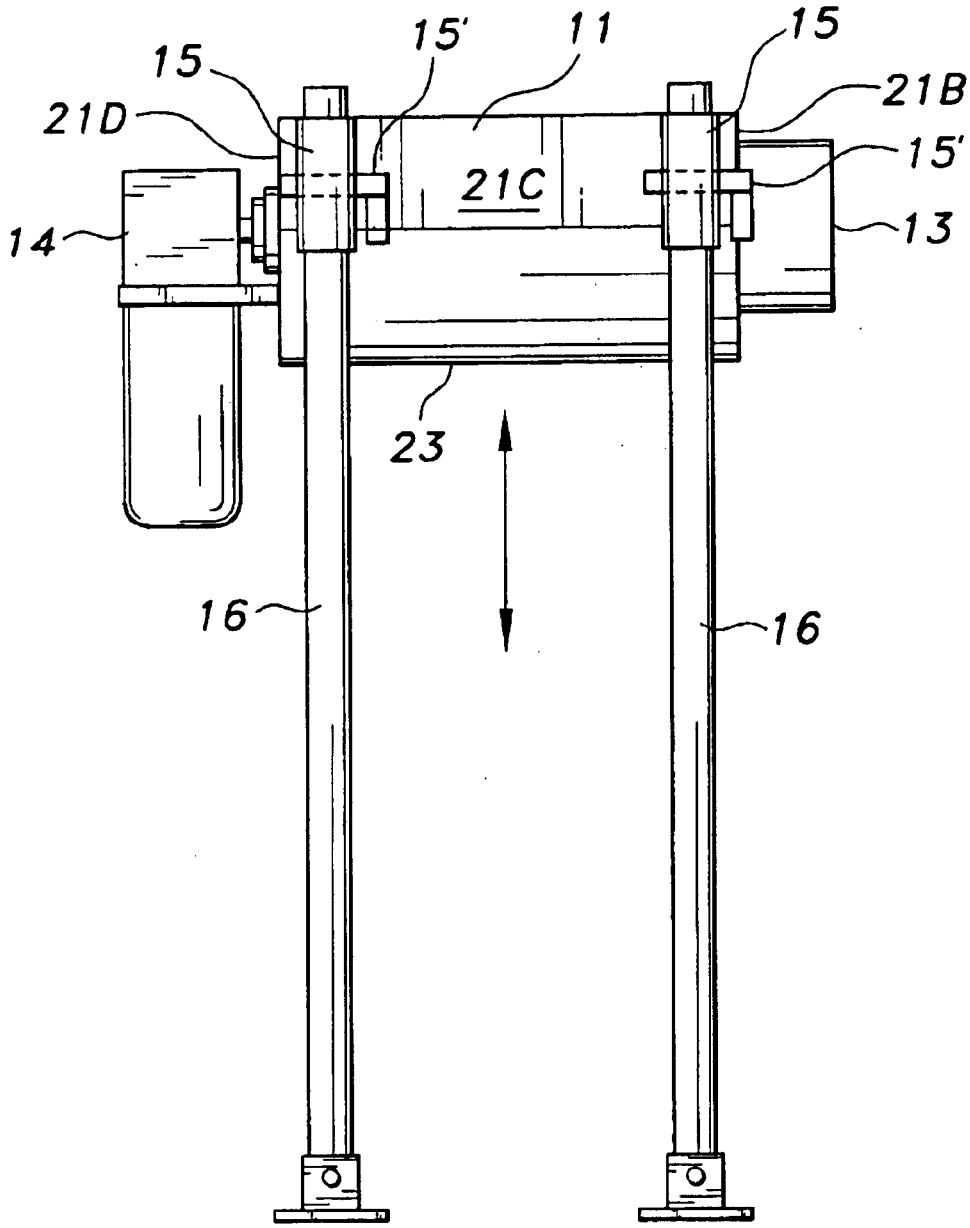
FIG. 4 is a side view of the variable feed hopper in a raised position.
Figure 5:
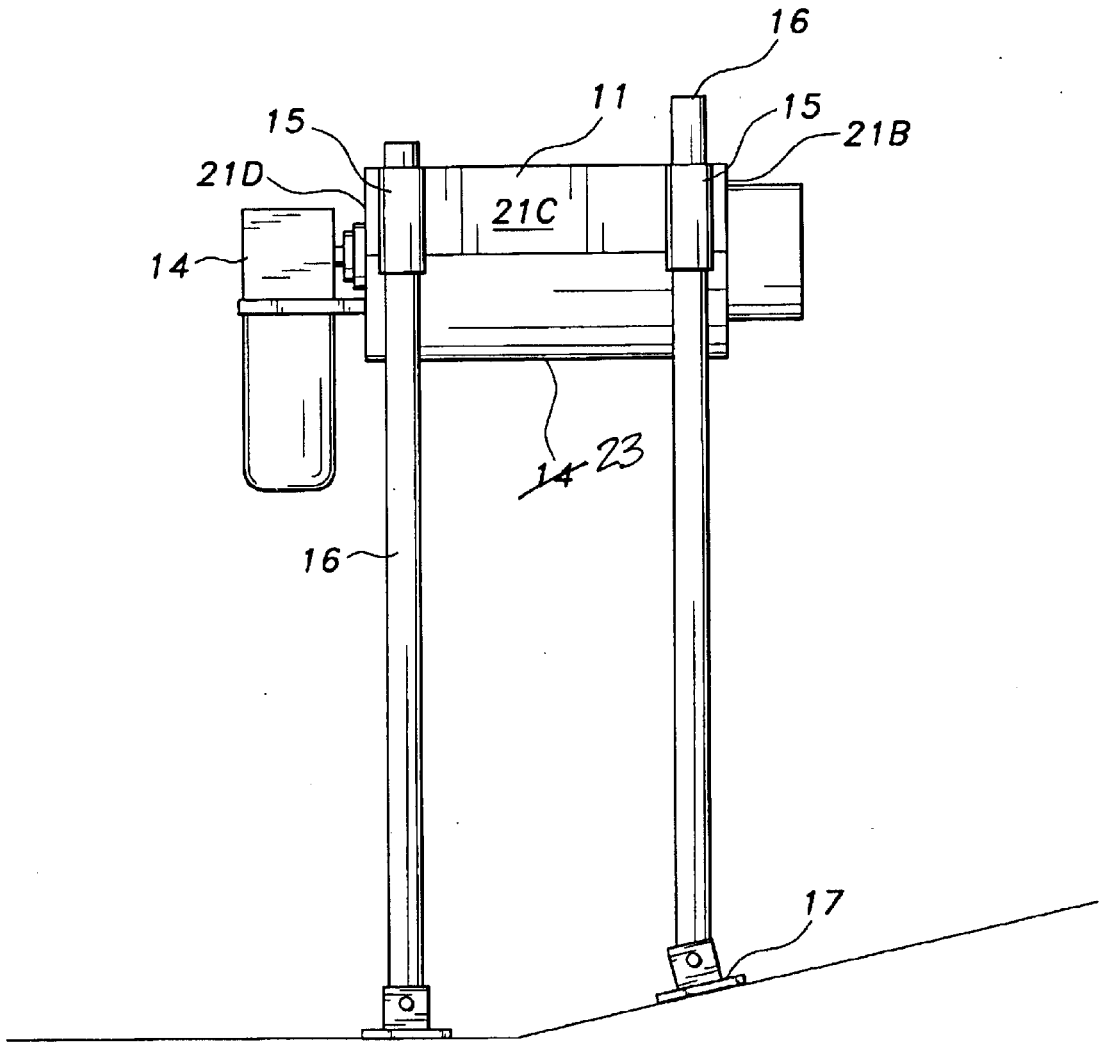
FIG. 5 is a side view of the variable feed hopper in a raised position.

The present invention is a portable volumetric feed hopper that is supported by adjustable legs to enable the hopper to be installed at a variety of heights. As shown in FIG. 1, the hopper 11 is a container having four vertical walls 21 A–D, and a bottom wall 22. The container includes a volumetric feed screw 12 for feeding concrete through an outlet 13. The feed screw 12 is provided within a generally centrally disposed feed channel 23 formed in the bottom wall 22 of the hopper 11. Feed channel 23 is generally an arcuate sufface. The outlet 13 is formed in wall 21B, and extends continuously from the feed channel 23.

Each corner of the hopper 11 includes a cylindrical sleeve 15 for adjustably receiving and locking into place a leg 16. Locking of the leg 16 is carried out by any suitable means, such as a pin 15' passing through alignable holes in the sleeve 15 and leg 16 for example. The adjustable legs 16 enable the hopper 11 to be positioned at various heights.

Figure 6:
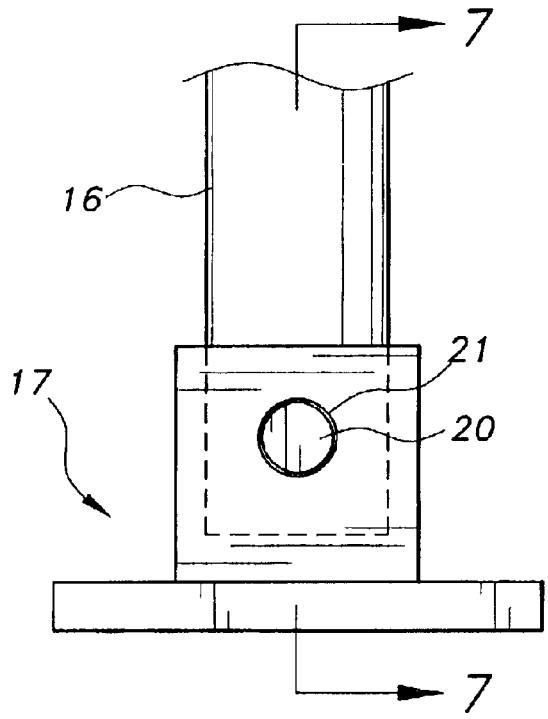
FIG. 6 is an enlarged side view of a pivoting foot attached to a leg of the hopper.
Figure 7:
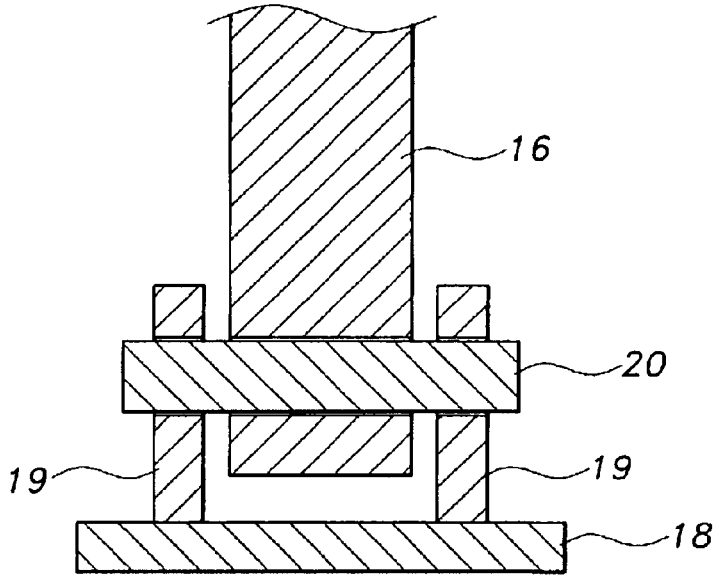
FIG. 7 is a cross-sectional view of the pivoting foot according to the present invention taken along line 7—7 of FIG. 6.

The lower end of each leg 16 of the hopper includes an aperture for receiving a pivot pin 20. The pivot pin 20 is also received in apertures 21 formed in arms 19 extending from the base portion 18 of a foot 17. See FIGS. 6 and 7. The ground engaging pivoting feet 17 of the hopper 11 enable the hopper 11 to be installed on uneven surfaces. The adjustable legs 16 and pivoting feet 17 of the hopper 11 together not only enables the hopper 11 to be positioned at the input of different types of concrete reclaimers but also enables the hopper 11 to be supported on flat or uneven surfaces.

A variable speed drive 14 is provided for driving the feed screw 12 to enable the feed rate of the hopper 11 to be adjusted to a rate as required for optimum performance of various concrete reclaimers.

It is to be understood that the present invention is not limited to the embodiment described above, but encompasses any and all embodiments within the scope of the following claims.

We claim:

1. A portable variable speed volumetric feed hopper comprising:

a container having first, second, third, fourth and fifth walls;

said first, second, third, and fourth walls being substantially vertical and defining a substantially rectangular opened top;

said first and third walls being diametrically opposed;

said second and fourth walls being diametrically opposed and extending between said first and third walls;

wherein a corner is defined between each of said first and said second walls, said first and said fourth walls, said third and said second walls, and said third and said fourth walls;

said fifth wall extending between said first and third walls, and coupled between second and fourth walls forming a closed bottom;

said fifth wall having a downward inclination from each of said first and said third walls, and forming a feed channel in the container extending between said second and said fourth walls, and said feed channel being generally centrally disposed between said first and third walls;

whereby said container being adapted to operatively contain a volume of concrete;

a discharge outlet defined in one of said second and said fourth walls;

means for feeding the volume of contained concrete through said discharge outlet;

said means for feeding being disposed within the feed channel of said container, and extending between said second and said fourth walls;

means for varying the rate at which the contained concrete is fed through said discharge outlet;

said means for varying being disposed on an exterior surface of said container, and coupled to said means for feeding; and means for supporting said container coupled to each said corner;

wherein said means for supporting being independently adjustable, such that said container is selectively supported at a predetermined height above a ground surface.

2. A portable variable speed volumetric feed hopper according to claim 1, wherein said means for supporting including a sleeve exteriorly mounted at each corner of said container, and an adjustable height leg slidably secured in each sleeve.

3. A portable variable speed volumetric feed hopper according to claim 1, wherein said means for supporting including four height adjustable legs, each one of said legs being mounted at each corner of said container, and each leg includes a foot pivotally attached to an end thereof.

4. A portable variable speed volumetric feed hopper according to claim 1, wherein said means for feeding includes a feed screw, said feed channel being an arcuate surface in said fifth wall; wherein said feed screw being substantially disposed in said feed channel.

5. A portable variable speed volumetric feed hopper according to claim 4, wherein said means for varying includes a drive coupled to said screw, said drive being mounted on the wall opposite the discharge outlet.

* * * * *